US012584666B2

(12) United States Patent
Ou

(10) Patent No.: US 12,584,666 B2
(45) Date of Patent: Mar. 24, 2026

(54) WINE CABINET OR REFRIGERATOR WITH REFRIGERATOR DOOR GLASS DEFROSTING FUNCTION

(71) Applicant: ZHONGSHAN NEWSHUNXIANG ELECTRICAL APPLIANCE CO., LTD., Zhongshan (CN)

(72) Inventor: Bo Ou, Zhongshan (CN)

(73) Assignee: ZHONGSHAN NEWSHUNXIANG ELECTRICAL APPLIANCE CO., LTD., Zhongshan (CN)

( * ) Notice: Subject to any disclaimer, the term of this patent is extended or adjusted under 35 U.S.C. 154(b) by 34 days.

(21) Appl. No.: 18/554,761

(22) PCT Filed: Jun. 4, 2021

(86) PCT No.: PCT/CN2021/098412

§ 371 (c)(1),
(2) Date: Oct. 10, 2023

(87) PCT Pub. No.: WO2022/213472

PCT Pub. Date: Oct. 13, 2022

(65) Prior Publication Data

US 2024/0288209 A1 Aug. 29, 2024

(30) Foreign Application Priority Data

Apr. 10, 2021 (CN) ..... 202110387530.6

(51) Int. Cl.
*F25B 47/02* (2006.01)
*A47B 73/00* (2006.01)
(Continued)

(52) U.S. Cl.
CPC ..... *F25B 47/022* (2013.01); *A47B 73/00* (2013.01); *F25D 11/00* (2013.01); *F25D 23/028* (2013.01)

(58) Field of Classification Search
CPC ..... F25D 21/06; F25D 2321/1412; A47F 3/0434; F25B 2347/00
See application file for complete search history.

(56) References Cited

U.S. PATENT DOCUMENTS 3,462,966 A * 8/1969 Reid ..... F25D 21/04 454/198
4,977,754 A 12/1990 Upton et al.

FOREIGN PATENT DOCUMENTS

CN 201865513 U 6/2011
CN 201977323 U 9/2011
(Continued)

OTHER PUBLICATIONS

International Search Report of PCT/CN2021/098412, Dec. 31, 2021, 5 pages with English translation.

*Primary Examiner* — Ana M Vazquez
(74) *Attorney, Agent, or Firm* — HSML P.C.

(57) ABSTRACT

A wine cabinet or refrigerator with a refrigerator door glass defrosting function includes a cabinet body, a door body, a compressor cavity provided in a rear portion of a lower portion of the cabinet body, a compressor, a condenser, an axial fan, an air intake cavity and an air output cavity, wherein the door body comprises a door frame, a glass door panel arranged on the door frame, and a door seal arranged at a rear portion of the door frame; an air intake hole is provided in the air intake cavity; the condenser is arranged in the air output cavity; the axial fan is arranged at a rear portion of the air output cavity; a hot air output connection port is arranged at a front end of the air output cavity; and the door frame is provided with an air inlet and a flow guide channel.

6 Claims, 7 Drawing Sheets

(51) Int. Cl.
*F25D 11/00* (2006.01)
*F25D 23/02* (2006.01)

(56) References Cited

FOREIGN PATENT DOCUMENTS

| | | | | |
|---|---|---|---|---|
| CN | 102379580 | A | | 3/2012 |
| CN | 104748486 | A | | 7/2015 |
| CN | 106196806 | A | | 12/2016 |
| CN | 106595175 | A | | 4/2017 |
| CN | 106642938 | A | | 5/2017 |
| CN | 207073976 | U | | 3/2018 |
| CN | 212870398 | U | | 4/2021 |
| CN | 217243518 | U | * | 8/2022 |
| JP | H09-101075 | A | | 4/1997 |

* cited by examiner

WINE CABINET OR REFRIGERATOR WITH REFRIGERATOR DOOR GLASS DEFROSTING FUNCTION

TECHNICAL FIELD

The present invention relates to a wine cabinet or refrigerator with a compressor for refrigeration. More specifically, the present invention relates to a wine cabinet or refrigerator with a defrosted glass door.

BACKGROUND

In the prior art a transparent glass door design is generally adopted in a wine cabinet or refrigerator in order to well display the internal wine or beverage. However, the glass door has two obvious disadvantages. One is that the glass door has poor insulation with increased energy consumption. The other is that the glass surface is easy to condense, resulting in dew dripping on the ground, damaging wooden floor, and poor use experience.

According to the query data, the thermal conductivity of a refrigerator foam door is about 0.5 W/($m^2$·K), the thermal conductivity of a refrigerator single-layer glass door is about 6.4 W/($m^2$·K), the thermal conductivity of a refrigerator hollow glass door is about 2.5-3.5 W/($m^2$·K), and the thermal conductivity of a refrigerator hollow LOW-E glass door is about 1.2-1.8 W/($m^2$·K). That is to say, even for the best hollow LOW-E glass door, its insulation effect is only about 30-40% of a foam door.

In order to solve the problem of poor insulation and increased energy consumption, the following measures are generally implemented: (1) designing the used glass into a double or multi-layer insulating glass, or a LOW-E hollow glass, which can greatly improve the insulation effect, but through which it still cannot reach the insulation effect of a foaming door body. (2) taking some other measures such as improving the refrigeration efficiency or strengthening heat insulation in other parts to compensate the heat loss of a glass door.

As regards the problem of easy condensation on a glass surface, the following measures are generally taken. One measure is to improve the insulation through the above methods so as to increase the temperature of a glass surface and thus improve the condensation on a glass surface. However, this approach is effective only when the relative humidity of the air does not exceed 75% RH. During some time periods (such as rainy season), in some areas, especially those areas near the ocean with high temperature and high humidity, the air humidity often exceeds 85% RH or even higher, and the condensation on a glass surface can not be avoided by employing any kinds of glass. Another measure is to heat glass by electricity with a general heating power of 50 W per square meter. In this way the surface temperature can be always higher than the dew point temperature after being charged with electricity and the condensation on a glass surface can be completely eliminated. The disadvantage of this way is that the glass which can be used for electric heating is rather expensive. Furthermore, in order to make the glass conductive, high power supply, connection lines and auxiliary elements such as controllers or sensors are needed, which will further increase the cost. The more components or elements the higher the probability of failure, which will reduce the product reliability. The employment of electric heating components will significantly increase the energy consumption of a refrigerator, which may not comply with the energy consumption regulations of some countries or regions, resulting in a limited sales market.

In the prior art Chinese patent CN 201020600472.8 disclosed a hollow glass door with electric heating, comprising an insulating glass and its surrounding borders. The used insulating glass further comprised a coated glass in the outer layer which could be electrically heated, a tempered and coated glass in the inner layer, and an organic glass in the middle layer. The technique can be effectively used to prevent from condensation, but with a high cost.

Chinese Patent Application CN 201611142188.9 disclosed a defrosting glass for a displaying refrigerator, comprised a rectangular Low-E glass matrix. The opposite surfaces of the Low-E glass matrix had two silver wires as positive and negative poles respectively, which contained silver more than 80% and were printed by screen printing and toughened. The port of each silver wire was welded with electric wires. But such a technology is also limited by cost issues.

Chinese patent CN 201510850785.6 disclosed a freezer, comprised a cabinet body and two glass doors. A cabinet opening was provided on the cabinet body and a sliding rail was provided on the cabinet opening. The glass doors were attached to the sliding rail. The freezer also comprised a first food basket and a second food basket. The handle of the first food basket had a first tilt bar, and the handle of the second food basket had a second tilt bar. Two opposite inclined guide rails were formed on the cabinet opening. The first and the second tilt bars were overlapped on the inclined guide rails. The peripheral size of the first food basket is greater than that of the second food basket, and the peripheral size of the second food basket is smaller than that of the glass doors. A freezer with such a structure is suitable for manual defrosting.

China patent CN 201720448929.X disclosed an automatic defrosting refrigerator, which could start a hidden defrosting system when the frost was too thick, and melt the frost through a heating tube to achieve the defrosting function. The hidden defrosting system was equipped with a tempered glass cover and installed at the bottom of the cabinet cavity. The heating tube was installed in the inner cavity of the tempered glass cover and firmly connected with the tempered glass cover through two connecting seats at its both ends.

Chinese patent CN 201510137932.5 disclosed a method and device for reducing refrigerator frost by using the dehumidifying principle. The device comprised an air condensing tube and an air-liquid separator, in which one end of the air condensing tube was connected with the outlet through an elbow, the other end was connected with a drain pipe through a thread connection pipe. The bottom of the drain pipe was connected with the air-liquid separator. There was a drainage hole on the air-liquid separator, the outer wall of the drain pipe was connected with an air inlet pipe, and an air inlet was set at the end of the air inlet pipe. The main body of the air condensing tube was equipped with one-way glass fiber layer and activated carbon layer from top to bottom, with grille on its inlet and outlet respectively. In such a technology the intersection location of dry air and wet air inside and outside the refrigerator was artificially changed, which would make the condensing conversion completed at the intersection location.

Therefore, it is necessary to provide a wine cabinet or refrigerator which can perform automatic defrosting without additional heating devices.

SUMMARY OF THE INVENTION

It is an object of the present invention to provide a wine cabinet or refrigerator in which the glass of a refrigerator door can be automatically defrosted without an additional electric heating device.

To accomplish the above-mentioned object of the present invention, the present invention provides a wine cabinet or refrigerator with a defrosted glass door, comprising a cabinet body, a door body, a compressor chamber at the lower part of the rear of the cabinet body, a compressor, a condenser, an axial flow fan, an air inlet chamber and an air outlet chamber, wherein the door body comprises a door frame, a glass door panel located on the door frame and a door seal at the rear of the door frame. The air inlet chamber is equipped with an air inlet hole, the condenser is located in the air outlet chamber and the axial flow fan is located on the rear of the air outlet chamber.

A hot air outlet interface is provided at the front of the air outlet chamber. There is an air inlet and a diversion channel on the door frame. The hot air in the diversion channel flows on the front surface of the glass door panel. When the glass door is in the closed state, the outlet interface of the hot air is connected with the diversion channel. When the glass door is in the open state, the connecting line between the outlet interface of the hot air and the diversion channel is disconnected.

In such a way, according to the present invention, the heat energy released by the condenser is used to defrost the surface of the glass door panel, in which the high cost of electric heating can be avoided and additional energy consumption is not substantially required.

The wine cabinet or refrigerator with a defrosted glass door of the present invention can be a wine cabinet or refrigerator with a side door or with a top door. They have the same design principle with slightly different specific structure. Preferably it is a wine cabinet or refrigerator with side open glass door, for example a wine cabinet or refrigerator with front open glass door.

For a wine cabinet or refrigerator with a front glass door, the cabinet body has a front opening, and the air inlet chamber and the air outlet chamber are set on the front side with the inlet hole being set on the front wall of the air inlet chamber and the hot air outlet interface extending through the front wall of the air outlet chamber.

The wine cabinet or refrigerator with a defrosted glass door of the present invention can also comprise an air intake box on which an outlet interface pipe and an inlet interface hole are equipped with. The air intake box is fixed with the bottom frame of the door frame, and the air outlet interface pipe is connected with the air inlet, and the hot air outlet interface is worked with the inlet interface hole.

As a specific embodiment of the wine cabinet or refrigerator with a defrosted glass door of the present invention, its diversion channel surrounds the door frame with hot air holes provided on the bottom, side and top of the door frame. The axis of the hot air holes are parallel to the front surface of the glass door panel.

As another specific embodiment of the wine cabinet or refrigerator with a defrosted glass door of the present invention, its diversion channel is provided on the bottom of the door frame with transverse air cavity and vertical outlet air holes provided on the top of the door frame. The front of the door frame is provided with an annular groove, and the bottom of the rear of the annular groove is provided with a vertical air inlet which is communicated with the diversion channel.

Furthermore, in the above embodiment it can further comprise a front glass plate which is inosculated with the annular groove. The gap between the front glass plate and the glass door panel forms a hot air cavity. The diversion channel, the hot air cavity, the transverse air cavity and the vertical outlet air holes are communicated with each other, and the hot air from the vertical outlet air holes blows to the front surface of the front glass plate.

Furthermore, in the above specific embodiment the transverse air cavity on the top of the door frame is connected with a mold cavity at the back, and the rear of the mold cavity is provided with a pressure relief hole through which the hot air flows to the top of the door seal.

In the wine cabinet or refrigerator with a defrosted glass door of the present invention, the air outlet chamber can be provided with a closing, and the bottom plate of the closing has an acute angle with horizontal surface below with outlet holes provided on it. The front wall of the air outlet chamber is equipped with exhaust holes.

In the wine cabinet or refrigerator with a defrosted glass door of the present invention the heat energy released from the condenser in the air outlet chamber will be guided into the door frame to defrost the front surface of the glass door panel without vulnerable components and with long service life and low cost.

The present invention is further explained in detail in combination with the drawings and implementation examples. However, these explanations are only an exemplary description of the present invention and are not a limitation of the present invention.

DETAILED DESCRIPTION OF THE INVENTION

Figure 1:
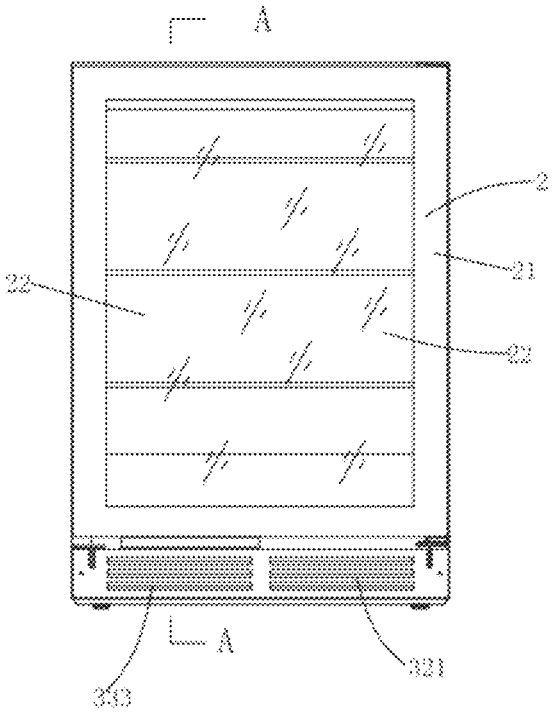
FIG. 1 is a main view of the first embodiment in the present invention.
Figure 2:
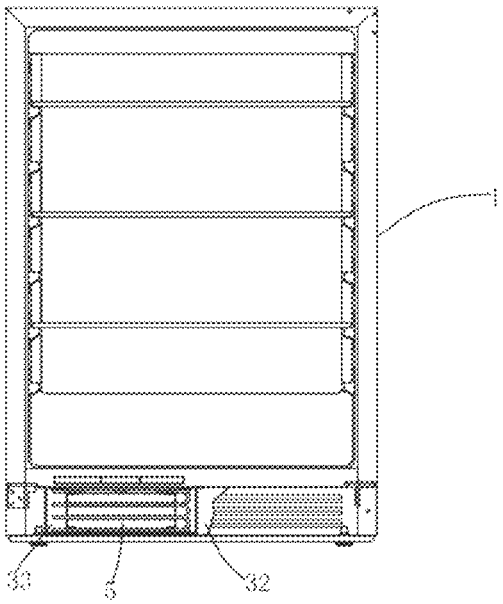
FIG. 2 is a local sectional view of the first embodiment in the present invention.

The present invention is further described in combination with the drawings.

Example 1

As shown in FIGS. 1-5, the wine cabinet or refrigerator with a defrosted glass door of the present invention comprises a front-opening cabinet body 1, a door body 2, a compressor chamber 31 at the lower part of the rear of the cabinet body, an air inlet chamber 32 and an air outlet chamber 33 provided on the front, a compressor 4, a condenser 5 and an axial flow fan 6. The door body 2 comprises a door frame 21, a glass door panel 22 disposed on the door frame and a door seal 23 disposed at the rear of the door frame. An air inlet hole 321 is provided on the front wall of the air inlet chamber 32. The condenser 5 is provided in the air outlet chamber 33 and the axial flow fan 6 is provided at the rear of the air outlet chamber 33. The outlet direction of the axial flow fan 6 is toward the condenser 5.

Figure 5:
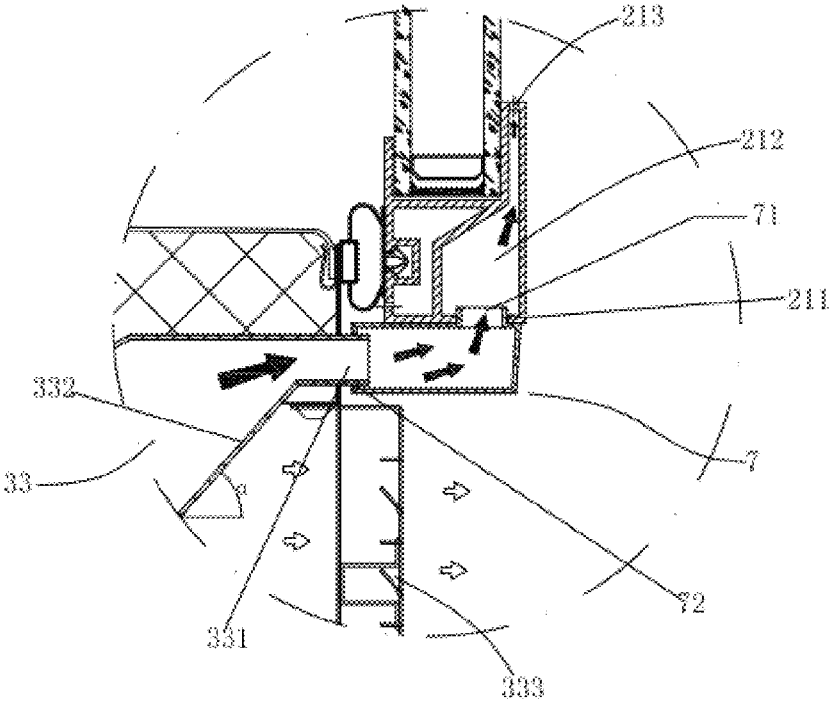
FIG. 5 is an enlarged view of site B in FIG. 3.

As shown in FIG. 5, the hot air outlet interface 331 is provided at the front end of the air outlet chamber 33, and the hot air outlet interface 331 extends through the front wall of the air outlet chamber 33.

The door frame 21 is provided with an air inlet 211 and a diversion channel 212, and the hot air in the diversion channel 212 flows on the front surface of the glass door panel 22.

When the glass door is in the closed state, the hot air outlet interface 331 is communicated with the diversion channel 212. When the glass door is in the opening state, the hot air outlet interface 331 is disconnected from the connecting line of the diversion channel 212.

Figure 3:
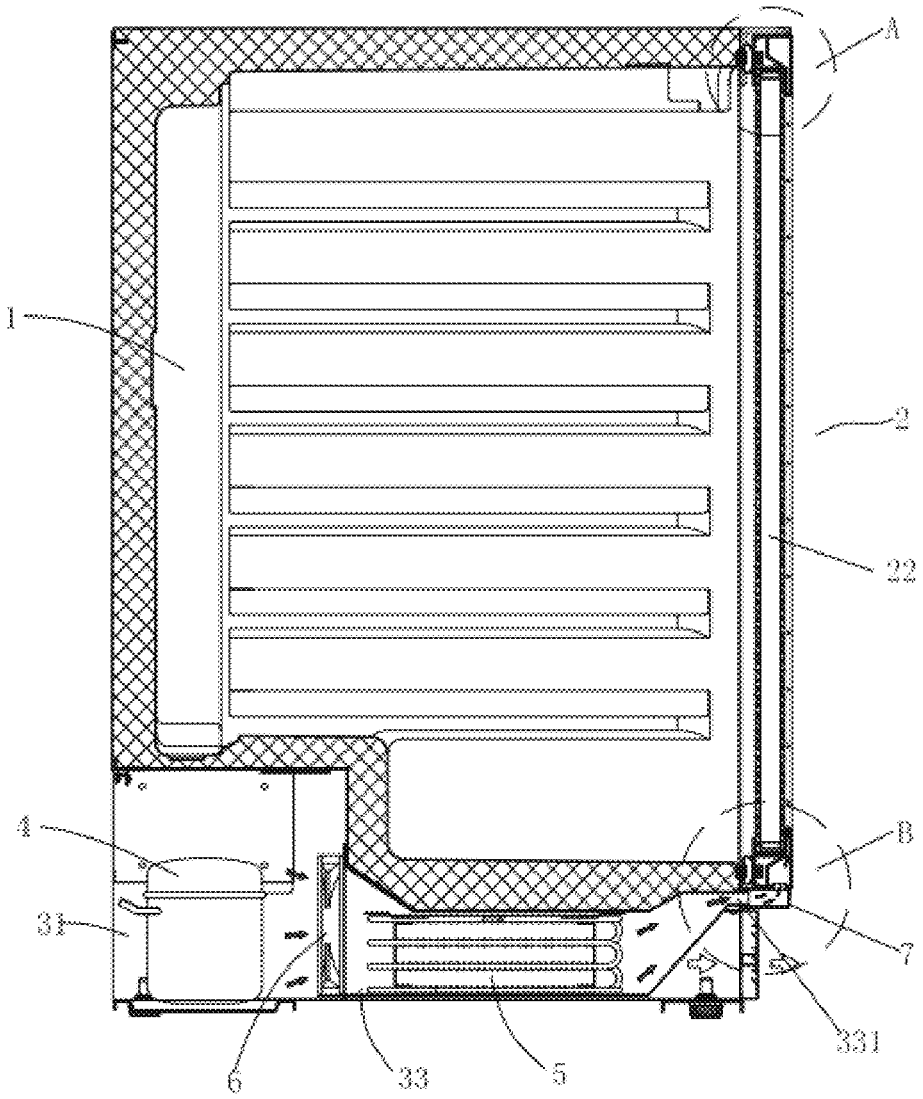
FIG. 3 is the A-A view of FIG. 1.
Figure 4:
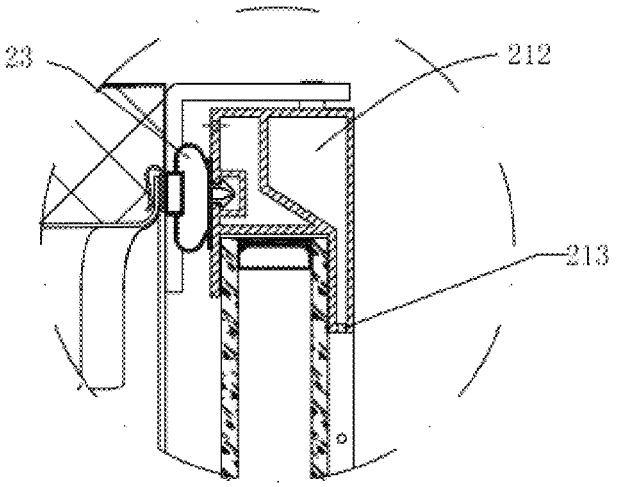
FIG. 4 is an enlarged view of site A in FIG. 3.

As a further improvement in the present invention, as shown in FIGS. 3 and 5, it also comprises an air intake box 7, which is provided with an outlet interface pipe 71 and an inlet interface hole 72.

The air intake box 7 is fixed to the bottom frame of the door frame 21, and the outlet interface pipe 71 is communicated with the air inlet 211, and the hot air outlet interface 331 cooperates with the inlet interface hole 72.

Figure 6:
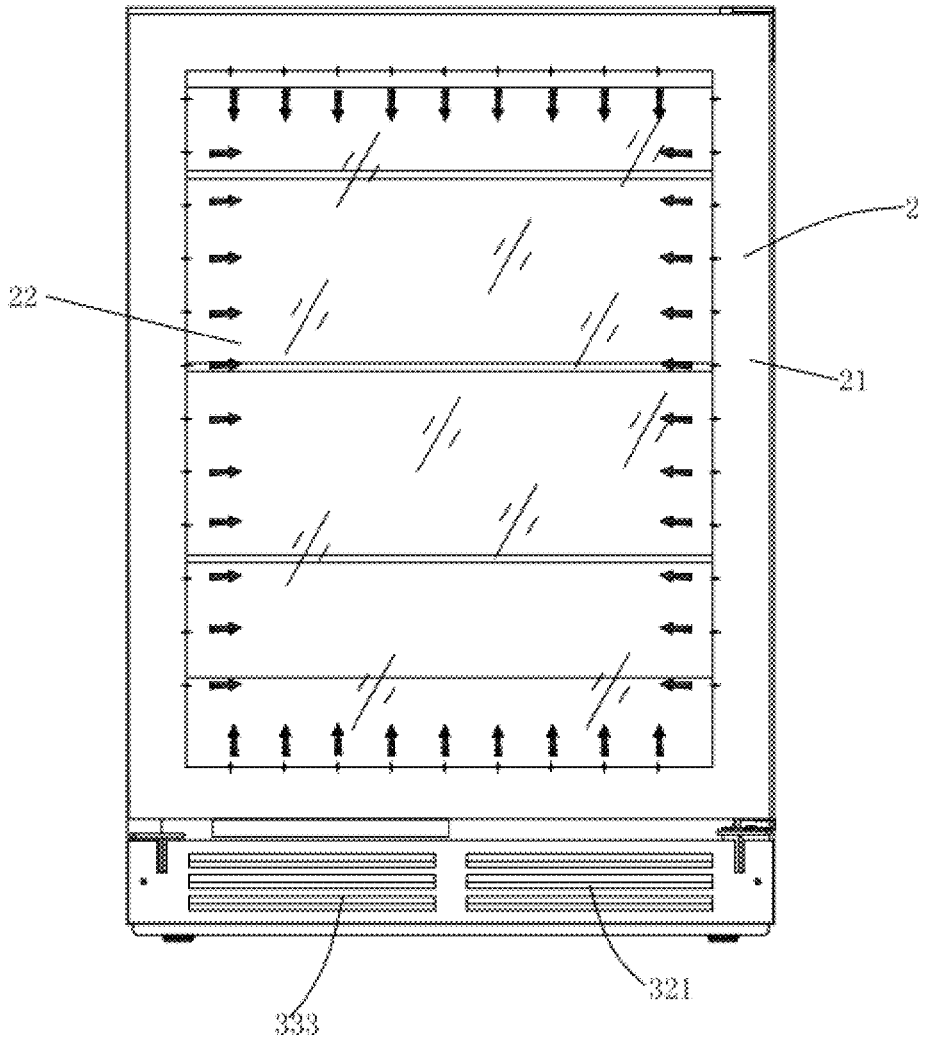
FIG. 6 is a view of the hot-air movement direction in the present invention.

The diversion channel 212 surrounds the door frame 21, and hot air holes 213 are provided at the bottom, side and top frames of the door frame 21, and the axis of the hot air holes 213 are parallel to the front surface of the glass door panel 22. The distribution of the hot air is shown in FIG. 6.

As a furthermore improvement in the present invention, the air outlet chamber 33 can be provided with a closing at its front end, and the bottom plate 332 of the closing has an acute angle $\alpha$ with horizontal surface below, and the bottom plate 332 is provided with air outlet holes.

Exhaust holes 333 are provided on the front wall of the air outlet chamber 33 with its direction shown by the hollow arrow in FIG. 5.

Example 2

Please refer to FIGS. 7-10. The diversion channel 212 is provided on the bottom frame of the door frame 21. The top frame of the door frame 21 is provided with a transverse air cavity 214 and vertical outlet air holes 215. The front of the door frame 21 is provided with an annular groove 216, and the bottom of the rear of the annular groove 216 is provided with a vertical air inlet 217 which is communicated with the diversion channel 212.

Figure 7:
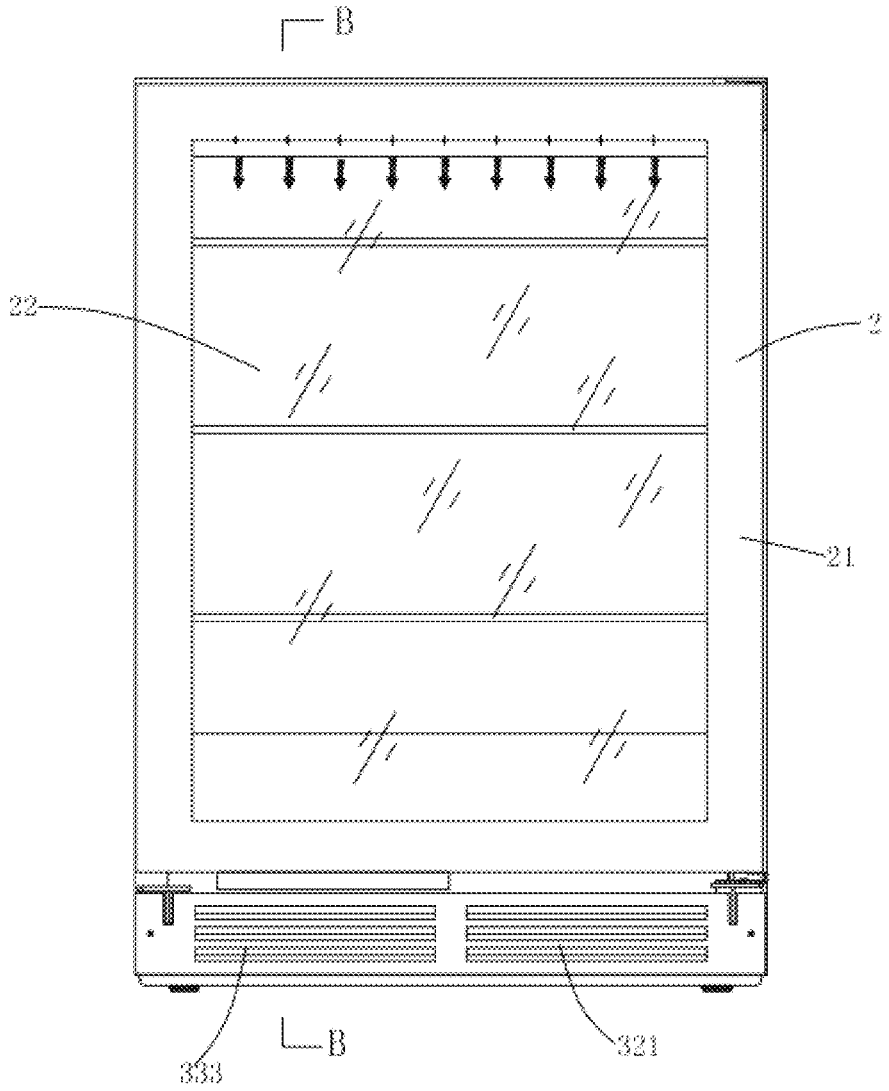
FIG. 7 is a main view of the second embodiment in the present invention.
Figure 8:
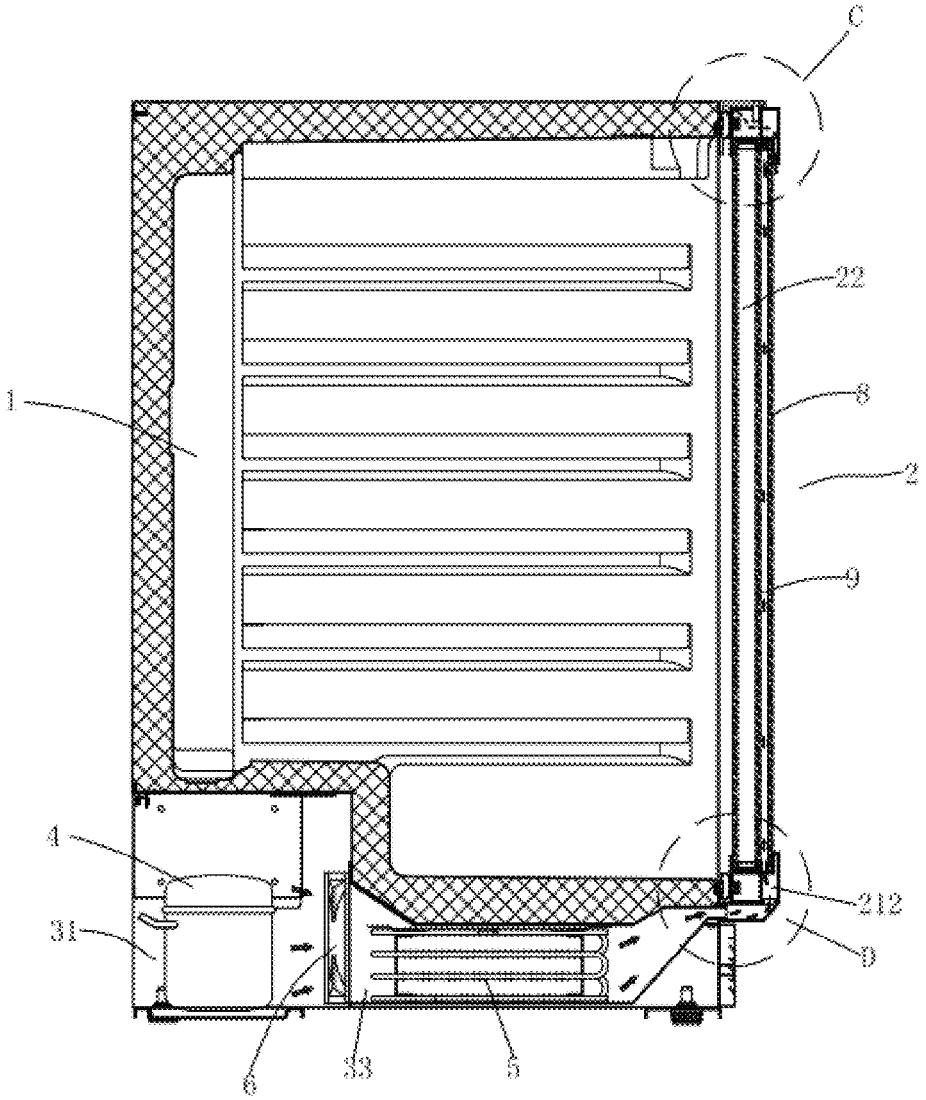
FIG. 8 is the B-B view of FIG. 7.
Figure 9:
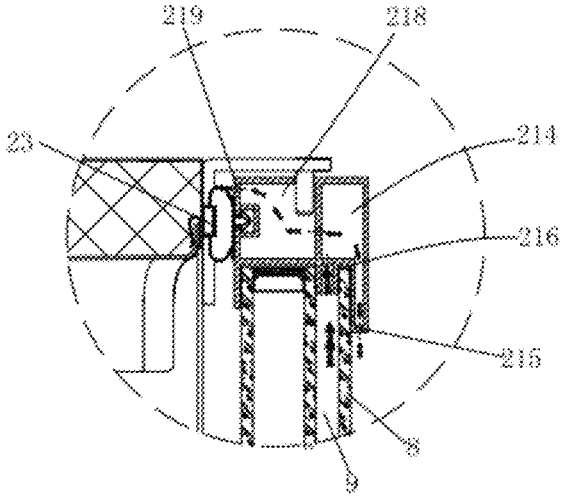
FIG. 9 is an enlarged view of site C in FIG. 8.
Figure 10:
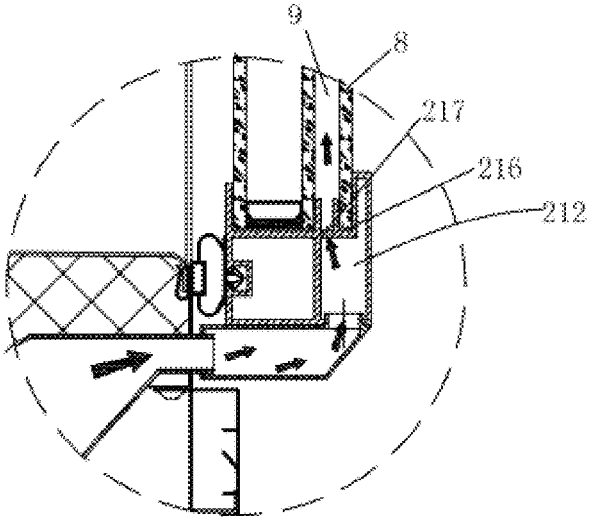
FIG. 10 is an enlarged view of site D in FIG. 8.

This embodiment further comprises a front glass plate 8. The front glass plate 8 is inosculated or embedded with the annular groove 216, and the gap between the front glass plate 8 and the glass door panel 22 forms a hot air cavity 9. The diversion channel 212, the hot air cavity 9, the transverse air cavity 214 and vertical outlet air holes 215 are communicated with each other. The hot air from vertical outlet air holes 215 blows to the front surface of the front glass plate 8, and the hot air flow moves from top to bottom down as shown in FIG. 7.

The transverse air cavity 214 on the top is connected with a mold cavity 218 at the back, and the rear of the mold cavity 218 is provided with a pressure relief hole 219 through which the hot air flows to the top of the door seal 23 to prevent it from frosting.

In the present application, the orientation or position relationship indicated by the terms "up", "down", "front", "back", "left", "right", "top", and "bottom" is based on the orientation or position relationship shown in the attached drawings, which is only for the clarity and convenience of the technical understanding and description and therefore cannot be understood as a limitation on the present patent.

The above description is only a preferred embodiment of the present invention. It should be noted that for those skilled in the art, several improvements and variations may be made without departing from the principles of the present invention, which is also regarded as the scope of protection of the present invention.

The invention claimed is:

1. A wine cabinet or refrigerator with a defrosted glass door, comprising: a cabinet body, a door body, a compressor chamber at a lower part of a rear of the cabinet body, a compressor, a condenser, an axial flow fan, an air inlet chamber and an air outlet chamber, wherein said door body comprises a door frame, a glass door panel located on said door frame and a door seal at a rear of said door frame, wherein said air inlet chamber is equipped with an air inlet hole, wherein said condenser is located in said air outlet chamber and said axial flow fan is located on a rear of said air outlet chamber, wherein a hot air outlet interface is provided at a front end of said air outlet chamber, there is an air inlet and a diversion channel provided on said door frame, and a hot air in said diversion channel flows on a front surface of said glass door panel, wherein when said glass door is in a closed state said hot air outlet interface is connected with said diversion channel, and when said glass door is in an open state a connecting line between said hot air outlet interface and said diversion channel is disconnected, wherein said cabinet body has a front opening, said air inlet chamber and said air outlet chamber are set on a front side, and said air inlet hole is set on a front wall of said air inlet chamber and said hot air outlet interface extends through the front wall of said air outlet chamber, and wherein said diversion channel is provided on a bottom frame of said door frame, a top frame of said door frame is provided with a transverse air cavity and vertical outlet air holes, a front of said door frame is provided with annular grooves, and a bottom frame of a rear of said annular grooves is provided with a vertical air inlet communicated with said diversion channel.

2. The wine cabinet or refrigerator of claim 1, wherein said wine cabinet or refrigerator further comprises an air intake box with which an outlet interface pipe and an inlet interface hole are equipped, said air intake box is fixed with a bottom frame of said door frame, said outlet interface pipe is connected with said air inlet hole, and said hot air outlet interface is worked with said inlet interface hole.

3. The wine cabinet or refrigerator of claim 1, wherein said diversion channel surrounds said door frame with hot air holes provided on a bottom, side and top frames of said door frame, and an axis of said hot air holes are parallel to the front surface of said glass door panel.

4. The wine cabinet or refrigerator of claim 1, wherein said door body further comprises a front glass plate, said front glass plate is inosculated with said annular grooves, a gap between said front glass plate and said glass door panel forms a hot air cavity, said diversion channel, said hot air cavity, said transverse air cavity and said vertical outlet air holes are communicated with each other, and the hot air from said vertical outlet air holes blows to a front surface of said front glass plate.

5. The wine cabinet or refrigerator of claim 1, wherein said transverse air cavity is connected with a mold cavity at a back, and a rear of said mold cavity is provided with a pressure relief hole through which the hot air flows to a top of said door seal.

6. A wine cabinet or refrigerator with a defrosted glass door, comprising: a cabinet body, a door body, a compressor chamber at a lower part of a rear of the cabinet body, a compressor, a condenser, an axial flow fan, an air inlet chamber and an air outlet chamber, wherein said door body comprises a door frame, a glass door panel located on said door frame and a door seal at a rear of said door frame, wherein said air inlet chamber is equipped with an air inlet hole, wherein said condenser is located in said air outlet chamber and said axial flow fan is located on a rear of said air outlet chamber, wherein a hot air outlet interface is provided at a front end of said air outlet chamber, there is an air inlet and a diversion channel provided on said door frame, and a hot air in said diversion channel flows on a front surface of said glass door panel, wherein when said glass door is in a closed state said hot air outlet interface is connected with said diversion channel, and when said glass door is in an open state a connecting line between said hot air outlet interface and said diversion channel is disconnected, and wherein a bottom plate of a closing of said air outlet chamber has an acute angle with horizontal surface below, said bottom plate is provided with air outlet holes, and exhaust holes are provided on a front wall of said air outlet chamber.

* * * * *